US005603636A

United States Patent [19]

Kanou et al.

[11] Patent Number: 5,603,636

[45] Date of Patent: Feb. 18, 1997

[54] ATTACHMENT OF TERMINAL CONTACTS TO COAXIAL CABLE END AND CABLE CONNECTOR HAVING TERMINAL CONTACTS

[75] Inventors: Tatsuo Kanou; Takashi Miyashita, both of Tokyo, Japan

[73] Assignee: Japan Aviation Electronics Industry, Limited, Tokyo, Japan

[21] Appl. No.: 536,665

[22] Filed: Sep. 29, 1995

[51] Int. Cl.[6] ..... H01R 17/04

[52] U.S. Cl. ..... 439/585; 439/399; 439/394; 29/828

[58] Field of Search ..... 439/63, 394, 399–400, 439/423–424, 581, 585, 578; 29/828, 861, 863

[56] References Cited

U.S. PATENT DOCUMENTS

| | | | |
|---|---|---|---|
| 3,335,392 | 8/1967 | Elliott | 439/423 |
| 3,383,457 | 5/1968 | Schemacher et al. | 439/63 |
| 3,510,827 | 5/1970 | Spangler | 439/394 |
| 3,514,737 | 5/1970 | Renshaw, Jr. | 439/63 |
| 3,743,748 | 7/1973 | Reeder | 439/63 |
| 3,828,298 | 8/1974 | Schemacher | 439/394 |
| 3,915,535 | 10/1975 | O'Keefe et al. | 439/63 |
| 4,010,538 | 3/1977 | O'Keefe et al. | 439/585 |
| 4,269,469 | 5/1981 | Audic | 439/424 |
| 5,114,366 | 5/1992 | Sato | 439/585 |

*Primary Examiner*—P. Austin Bradley
*Assistant Examiner*—Jill Demello
*Attorney, Agent, or Firm*—Laff, Whitesel, Conte & Saret, Ltd.

[57] ABSTRACT

In connecting a center contact and an outer contact of a terminal contact set to a center conductor and an outer conductor of a coaxial cable at its cable end, the center and outer contacts are formed by punching an electroconductive plate, as a contact frame, integral with each other and with first and second frame portions connected to each other by bridge portion and carrying center and outer contacts, respectively. After the center and the outer contacts are connected to the center and outer conductors, respectively, those contacts are separated from the first and second frame portions. The center contact comprises first press-fit portions to be press-fitted to the center conductor and first holding portion to hold a first cover of the cable insulating the center conductor from the outer conductor. The outer contact (2) comprises second holding portion for holding a second cover of the cable insulating and covering the outer conductor, and second press-fit portion to press-fit to the outer conductor. The second press-fit portion has a press-insert portion to be contacted with the outer conductor and to clamp the first cover, and a guide piece for guiding the second cover of the cable to a position between the second press-fit portion. The center and outer contacts can be assembled, as connector contacts, into a plug insulator to form a plug connector.

10 Claims, 7 Drawing Sheets

ATTACHMENT OF TERMINAL CONTACTS TO COAXIAL CABLE END AND CABLE CONNECTOR HAVING TERMINAL CONTACTS

BACKGROUND OF THE INVENTION

The present invention relates to a method for attaching a terminal contact set to a coaxial cable at its cable end and, in particular, to such a method using a contact frame having the terminal contact set integrally formed from a metal plate.

Generally, a coaxial cable is used as a transmission line and comprises a first conductor, as an center or inner conductor, centered inside, a first conductor, as an outer conductor, extending coaxial with the center conductor, a first insulator cover covering and insulating the center conductor from the outer conductor, and a second cover or an outer jacket covering and insulating the outer conductor.

When the coaxial cable is used for electrically connecting between a two electrical apparatus, cable ends thereof are processed to expose the center and outer conductor ends which are, in turn, connected to electrical circuits in the apparatus.

In order to make it easy to connect the center conductor and the outer conductor to the circuit, a terminal contact set are attached to the cable end. The terminal contact set is often assembled in a connector insulating as connector contacts to form an electrical connector such as a plug connector.

A set of the terminal contacts comprises a first contact element or a center contact to be connected to the center conductor end of the coaxial cable, and a second contact element or an outer contact to be the outer conductor of the coaxial cable.

In the prior art, the center contact and the outer contact are produced independently from each other by, for example, punching metallic plates to form center contact flat parts by use of a die and to form outer contact flat parts by use of a different die, respectively.

Subsequently, the outer contact is fitted to the outer conductor end and then mechanically fixed to the outer jacket, by deforming the outer contact flat plate. On the other hand, the center contact is fitted to the center conductor end and then mechanically fixed to the second cover, by deforming the center contact flat part.

However, the terminal contact set for the coaxial cable as described above is disadvantageous in that the center contact and the outer contact are independently produced into the flat parts by the use of the two different metallic plates and the two different dies.

In the meanwhile, attachment of the center contact and the outer contact to center conductor end and the outer conductor end of the coaxial cable is carried out in the manner wherein an increased number of steps are required and a work efficiency is extremely low so that an assembling operation inevitably requires a relatively long time. In the manner, at first, the center contact part is brought into contact with the center conductor and is deformed or crimped to press-fit to the center conductor. Thereafter, the outer contact part is brought into the outer conductor and deformed and crimped to press-fit to the outer conductor.

SUMMARY OF THE INVENTION

Therefore, it is an object of the present invention to provide an improved method for attaching a terminal contact set to a cable end of a coaxial cable with a simple process and with a reliability.

It is another object of the present invention to provide a contact frame for use in the improved method as described above, wherein a set of center contact and outer contact can be treated as a single part before being attached to the cable end, thereafter, being separated.

It is a still another object to provide a contact carrier tape having a plurality of the contact frames which can feed the contact frames one after another, to an automatic assembling process of the attachment of the terminal contact set to the cable ends.

According to the present invention, there is provided with a method for attaching terminal contacts to a cable end of a coaxial cable comprising a first conductor centered inside, a second conductor extending coaxial with the first conductor, a first insulating cover covering and insulating the first conductor from the second conductor, and a second insulating cover covering the second conductor, the terminal contacts comprising an electroconductive first contact element to be electrically connected to an end of the first conductor at the cable end and an electroconductive second contact element to be electrically connected to the second conductor. The method comprises steps of; preparing a contact frame by punching an electroconductive plate material, the contact frame comprising the first contact element, the second contact element, a first frame portion carrying the first contact element, a second frame portion carrying the second contact element, and a bridge portion connecting the first and the second frame portions with a first distance left therebetween to thereby maintain a first predetermined positional relation between the first and the second contact elements; processing the cable end of the coaxial cable to thereby expose the first conductor end, the first insulating cover at the cable end, and the second conductor end, the first conductor end and the second conductor end being separated the first distance from each other by the first insulating cover along the coaxial cable to thereby have a second predetermined positional relation therebetween which matches to the first predetermined positional relation; attaching the contact frame to the cable end so that the first contact element and the second contact element are secured to the first conductor end and the second conductor end, respectively; and separating the first contact element and the second contact element from the first frame portion and the second frame portion, respectively.

In the method, the first contact element may comprises a first press-fit portion and a first holding portion, the first press-fit portion being crimped to press-fit onto the first conductor end and the first holding portion being crimped to hold the first cover end during the attaching step, and wherein the second contact element comprises a second press-fit portion and a second holding portion, the second press-fit portion being crimped to press-fit onto the second conductor end after penetrating the second cover and the second holding portion being crimped to hold the second cover during the attaching step.

The second press-fit portion has a press-insert portion and a guide piece, the press-insert portion penetrating the second cover to be brought into contact with the second conductor and to clamp the first cover end in a radial direction in the attaching step and the guide piece guiding the second cover to a position surrounded by the second press-fit portion in the attaching step.

The present invention also provides the contact frame used in the method, which is made by punching an electroconductive plate material, and which comprises: a first contact portion for the first contact element; a second contact portion for the second contact element; a first frame portion carrying the first contact portion; a second frame portion carrying the second contact portion; and a bridge portion connecting the first and the second frame portions with a first distance left therebetween to thereby maintain a first predetermined positional relation between the first and the second contact portions.

Further, the present invention provides a contact carrier tape for supplying a contact frame in the method. The contact carrier tape is made by periodically and sequentially punching a metal strip and comprises; a first and a second strip extending in parallel to each other with a space left therebetween; a plurality of first contact portions carried by the first strip at first intervals, each of the first contact portions being for the first contact element; a plurality of second contact portions carried by the second strip at second intervals equal to the first intervals, each of the second contact portions being for the second contact element; and a plurality of bridge portions connecting the first and the second strips at third intervals to thereby maintain the space along the first and the second strips and a first predetermined positional relation between each one of the first contact portions and an adjacent one of the second contact portions, whereby the contact carrier tape comprising a plurality of contact frames continuously connected to one by one.

The present invention further provides a terminal contact set for coaxial cable comprising a center conductor, a first insulating cover covering the center conductor, an outer conductor surrounding the first cover, and a second insulating cover covering the outer conductor, the terminal contact set comprising an electroconductive center contact to be electrically connected to the center conductor and to mechanically hold the first cover, and an electroconductive outer contact to be electrically connected to the outer conductor and to mechanically hold the second cover. The center contact comprises a first press-fit portion for press-fitting the center conductor and a first holding portion for holding the first cover, the outer contact comprising a second holding portion for holding the second cover and a second press-fit portion for press-fitting the outer conductor after penetrating the second cover, the second holding portion having a latch portion for inhibiting the cable from being released from the outer contact, the second press-fit portion having a press-insert portion for penetrating the second cover to be brought into contact with the outer conductor and to clamp the first cover in a radial direction, and a guide piece for guiding the second cover of the cable to a position surrounded by the second press-fit portion.

The present invention further provides a plug connector using the terminal contact set, wherein: the plug connector comprises a plug insulator accommodating the center contact and the outer contact, the plug insulator comprising a center contact inserting portion accommodating the center contact, an outer contact inserting portion adjacent to the center contact inserting portion and accommodating the outer contact, and a latch receiving portion for engaging the latch portion to the outer contact inserting portion.

The plug insulator comprises a guide groove for exposing as a first contacting portion a part of the first holding portion outwardly from the center contact inserting portion, and a connecting window for exposing as a second contacting portion a part of the second press-fit portion outwardly from the outer contact inserting portion.

Figure 1:
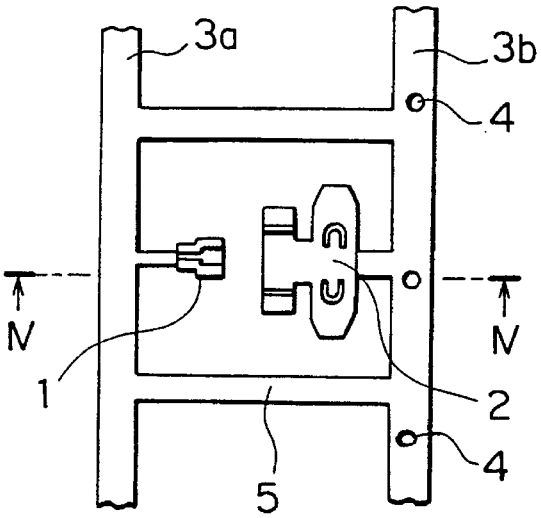
FIG. 1 is a plan view of a contact frame of a contact carrier tape according to this invention with a center contact and an outer contact of a terminal contact set in a flat part formed by a punching operation of a metal plate.

DESCRIPTION OF THE PREFERRED EMBODIMENT:

Now, description will be made as regards embodiments of this invention with reference to the drawing.

Figure 2:
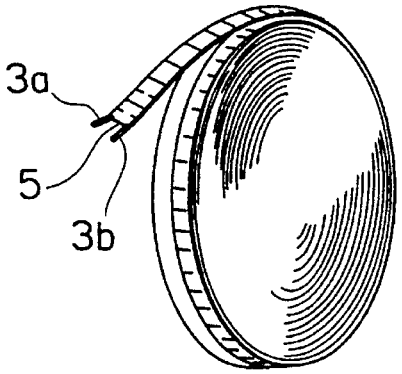
FIG. 2 is a perspective view of the contact carrier tape illustrated in FIG. 1 which is wound around a reel.

FIGS. 1 and 2 show a contact frame portion and a contact carrier tape having a plurality of contact frames continuously connected to one another according to one embodiment of this invention. Each contact frame comprises a center contact 1 and an outer contact 2 and first and second frame portions or carriers 3*a* and 3*b* which are integrally formed from a metal plate or strip by punching the metal strip. The first and the second carriers 3*a* and 3*b* are arranged in parallel to each other with a predetermined space left therebetween and are connected to each other by bridging portions to maintain the space. A plurality of the center contacts 1 are connected to the first carrier 3*a* at first intervals along the first carrier 3*a*. While a plurality of the outer contacts 2 are connected to the second carrier 3*b* at a second intervals along the second carrier 3*b* equal to the first intervals. Thus, each one of the center contacts 1 and adjacent one of the outer contacts 2 are maintained in a fixed or predetermined relative positional relation.

More specifically, the center contact 1 and the outer contact 2 are formed in the manner which will presently be described. The plate material is subjected to a punching operation to form the first and the second carriers 3*a* and 3*b* at opposite longitudinal sides of the plate material, respectively. Simultaneously, the center contact 1 and the outer contact 2 are formed by the punching operation into a flat part. A plurality of sets of the center contacts and outer contacts are successively and continuously formed in a continuous tape form by repeating the punching operation of a metal strip. For convenience of illustration, only one center contact 1 and only one outer contact 2 are shown in FIG. 1. The center contact 1 and the outer contact 2 are integrally formed with the first and the second carriers 3*a* and 3*b*, respectively, so that the top ends of the center contact 1 and the outer contact 2 are faced to each other at a predetermined space left therebetween. Thus, the plate material is formed into a belt-like or a tape like contact frame, that is, a contact carrier tape, by the punching operation.

Thereafter, a series of contact frames or the contact carrier tape is wound around a reel as illustrated in FIG. 2. This makes it easy to handle the contact frame upon plating and assembling of the connector after the center contacts 1 and the outer contacts 2 are successive formed.

Referring back to FIG. 1, the second carrier 3*b* is provided with a plurality of pilot holes 4 also formed by the punching operation and spaced at an equal interval. During plating and assembling, the pilot holes 4 serve to pick up every pair of the center contact 1 and the outer contact 2 at an equal pitch. A plurality of belt-like bridges 5 are connected between the first and the second carriers 3*a* and 3*b*. The bridges 5 are also formed by the punching operation of the plate material. The first and the second carriers 3*a* and 3*b* serve to maintain a relative positional relationship between the center contact 1 and the outer contact 2.

Figure 3:
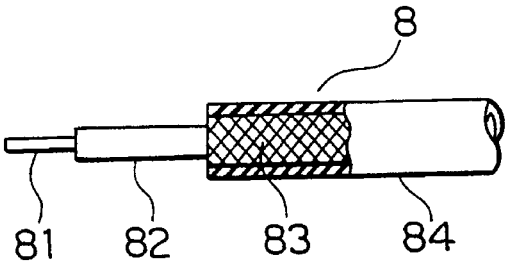
FIG. 3 is a partial sectional side view of a cable end of a coaxial cable to be connected to the terminal terminal contact set according to this invention.

FIG. 3 shows a coaxial cable 8 to be press-fitted to the center contact 1 and the outer contact 2. The coaxial cable 8 comprises a center conductor 81, a first insulating cover 82 covering the center conductor 81, an outer conductor 83 surrounding the first cover 82, and a second insulating cover 84 covering the outer conductor 83. The outer conductor 83 comprises a braid of metal wires. A cable end of the coaxial cable 8 is processed to expose an end portion of the center conductor 81, an end of the first insulator cover 82 and an end of the outer conductor 83 of the cable so that the center conductor end is separated or apart from the outer conductor end by the first insulator cover end portion along the cable 8, as shown in FIG. 3. An end of the second insulator cover or outer jacket 84 is also processed to match with the outer conductor end.

Figure 4:
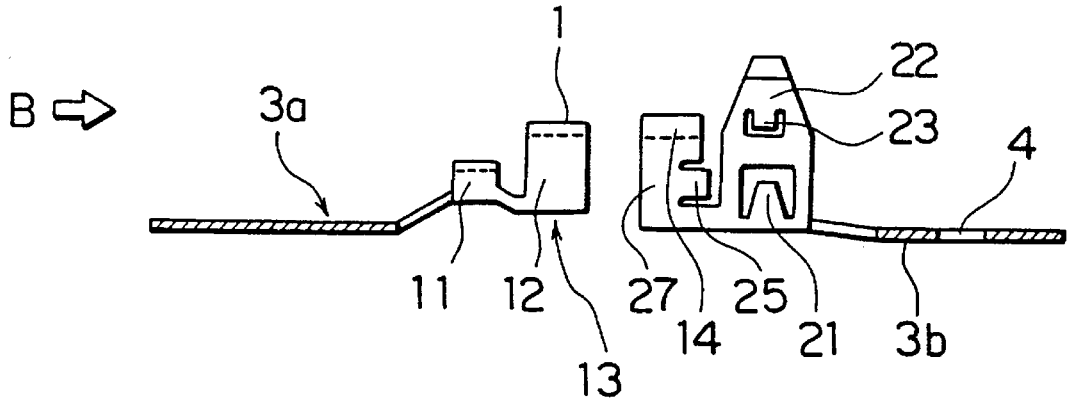
FIG. 4 is a sectional view of the center contact and the outer contact after transformed from the flat part into a deformed shape, taken along a line IV—IV in FIG. 1.
Figure 5:
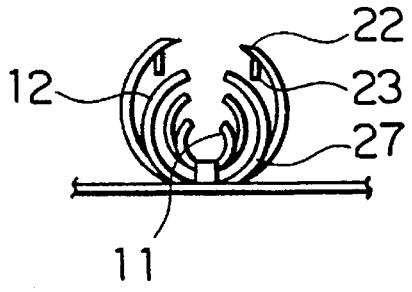
FIG. 5 is a front view of the center contact and the outer contact as seen from a direction B depicted in FIG. 4.
Figure 6A:
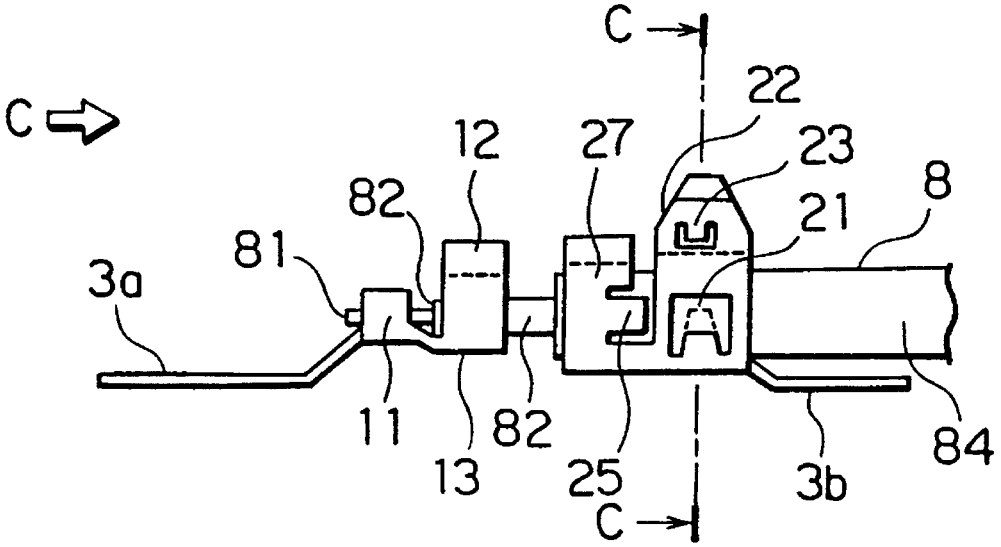
FIG. 6(A) is a side view of the coaxial cable illustrated in FIG. 3 with the center and the outer contacts illustrated in FIG. 4 connected thereto.
Figure 6B:
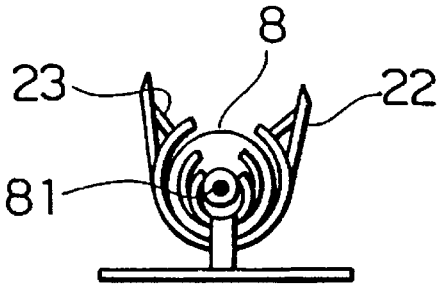
FIG. 6(B) is a front view of the coaxial cable within the center and outer contacts illustrated in FIG. 6(A) as seen from a direction C.

As best seen from FIGS. 3 through 5, the center contact 1 integrally connected to the first carrier 3*a* has a first press-fit portion 11 of a pair of pieces to be press-fitted to the center conductor 81 and a first holding portion of a pair of pieces 12 for holding a periphery of the first cover 82. The pair of pieces of the first press-fit portion 11 symmetrically extend from a common lower end at the bottom of the center contact 1 to be opposite to each other. Likewise, the pair of pieces of the first holding portion 12 symmetrically extend from a common lower end at the bottom of the center contact 1 to be opposite to each other. The center contact 1 has a generally U-shaped or V-shaped section.

The outer contact 2 comprises a second holding portion of a pair of pieces 27 and a second press-fit portion of a pair of pieces 22 having a common lower end contiguous to that of the second holding portion 27 for penetrating the second cover 84 to be press-fitted to the outer conductor 83. The pair of pieces of the second holding portion 27 symmetrically extend from the common lower end at the bottom of the outer contact 2 to be opposite to each other. Likewise, the pair of pieces of the second press-fit portion 22 symmetrically extend from the common lower end at the bottom of the outer contact 2 to be opposite to each other. The outer contact 2 has a generally U-shaped or V-shaped section.

Each of pieces of the second press-fit portion 22 has a tapered end. The pair of pieces of the second holding portion 27 have a pair of latch portions 25 to be engaged with an insulator 7 which will later be described in conjunction with FIG. 11. The pair of pieces of the second press-fit portion 22 have a press-insert portion 21 of a pair of pieces for penetrating the second cover 84 and the outer conductor 83 of the coaxial cable 8 to clamp the first cover 82 in a radial direction, and a pair of guide pieces 23 for guiding the second cover 84 of the coaxial cable 8 to a position between the pair of pieces of the second press-fit portion 22.

Figure 7A:
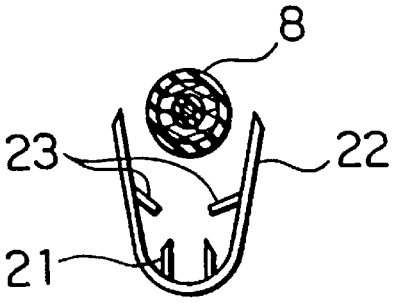
FIGS. 7(A), 7(B), 7(C), and 7(D) are sectional views for describing an assembling operation of steps of attaching the outer contact to the coaxial cable.
Figure 7B:
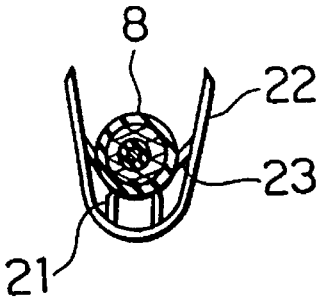
Figure 7C:
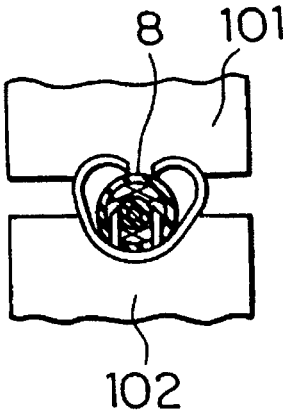
Figure 7D:
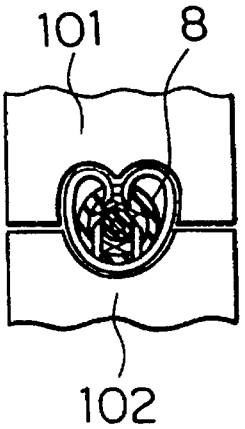

Description will proceed to an operation of connecting the center contact 1 and the outer contact 2 to the coaxial cable 8. As illustrated in FIGS. 6(A), 6(B), 7(A), and 7(B), the center contact 1 and the outer contact 2 are coupled to the coaxial cable 8. Subsequently, as illustrated in FIGS. 7(C) and 7(D), the center contact 1 and the outer contact 2 are crimped or vertically clamped by press-fit jigs 101 and 102, such as a crimper and an anvil, to be press-fitted to the coaxial cable 8. At this time, the coaxial cable 8 is guided by the guide piece 23 so that the outer conductor 83 is brought into contact with the press-insert portion 21. The second press-fit portion 22 is crimped or curved to be rounded along arc-shaped depressions formed on a surface of the upper press-fit jig 101 so that the top ends of the second press-fit portion 22 approach each other. When the press-fit jigs 101 and 102 come closer, the top ends of the second press-fit portion 22 are brought into contact with the outer conductor 83. Finally, the coaxial cable 8 is held by the bottom of the outer contact 2 and the top ends of the second press-fit portion 22 at a predetermined height (crimp height).

The center contact 1 and the outer contact 2 are made to maintain a relative positional relationship by the first and the second carriers 3*a* and 3*b* connected through the bridges 5, as illustrated in FIG. 1. Accordingly, the center and the outer contacts 1 and 2 are prevented from being shifted in position with respect to each other due to the force applied by the press-fit jigs 101 and 102. Thus, the center and the outer contacts 1 and 2 are properly coupled to the coaxial cable 8.

Figure 8:
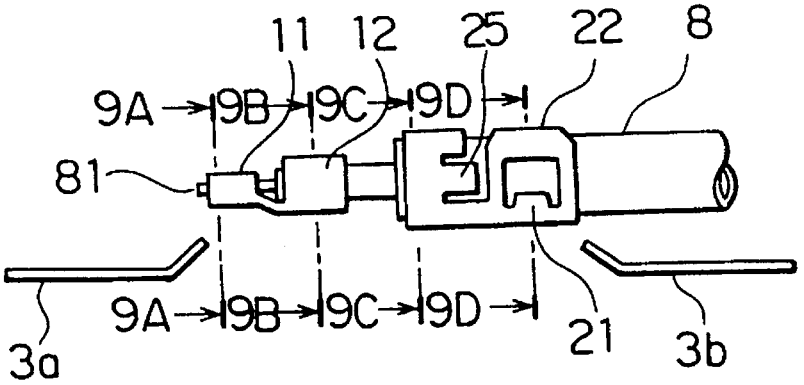
FIG. 8 is a side view of the center contact and the outer contact from which frame portions as carriers are separated and released after completion of the attachment.
Figure 9A:
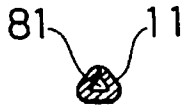
FIG. 9(A) is a sectional view taken along a line 9A—9A in FIG. 8.
Figure 9B:
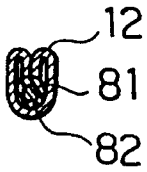
FIG. 9(B) is a sectional view taken along a line 9B—9B in FIG. 8.
Figure 9C:
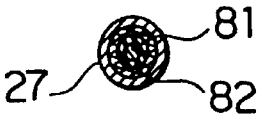
FIG. 9(C) is a sectional view taken along a line 9C—9C in FIG. 8.
Figure 9D:
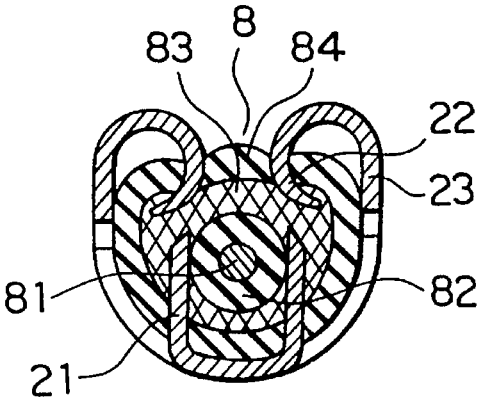
FIG. 9(D) is a sectional view taken along a line 9D—9D in FIG. 8.
Figure 9E:
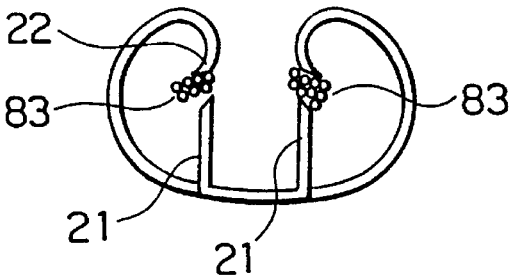
FIG. 9(E) shows press-fit portion between an outer conductor of the coaxial cable and the outer contact press-fitted to the outer conductor.

After the center and the outer contacts 1 and 2 are coupled to the coaxial cable 8, the first and the second carriers 3*a* and 3*b* are released from the center and the outer contacts 1 and 2. FIGS. 9(A), 9(B), 9(C), and 9(D) show the relationships between the outer contact 2 and the coaxial cable 8 at several sections (taken along lines 9A—9A, 9B—9B, 9C—9C, and 9D–9D in FIG. 8) when the center and the outer contacts 1 and 2 are press-fitted to the top end portion of the coaxial cable 8 as described above. FIG. 9(E) shows a press-fit condition between the outer conductor 83 of the coaxial cable 8 and the press fit portion 22 of the outer contact 2.

Specifically, the first press-fit portions 11 of the center contact 1 are press-fitted to the center conductor 81. An outer surface of the first cover 82 is held by the first holding portions 12 of the center contact 1. An outer surface of the second cover 84 is held by the second holding portions 27 of the outer contact 2. The second press-fit portion 22 of the outer contact 2 penetrates the second cover 84 to press-fit the outer conductor 83. The press-insert portion 21 of the outer contact 2 penetrates the second cover 84 and the outer conductor 83 to clamp the first cover 82 in a radial direction.

Figure 10A:
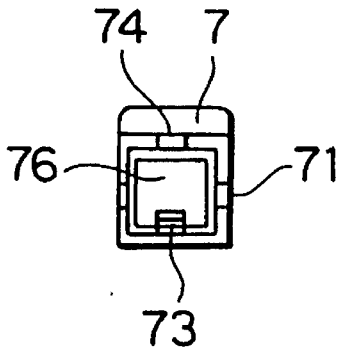
FIG. 10(A) is a front view of a plug insulator for accommodating the terminal contact set to form plug connector according to this invention.
Figure 10B:
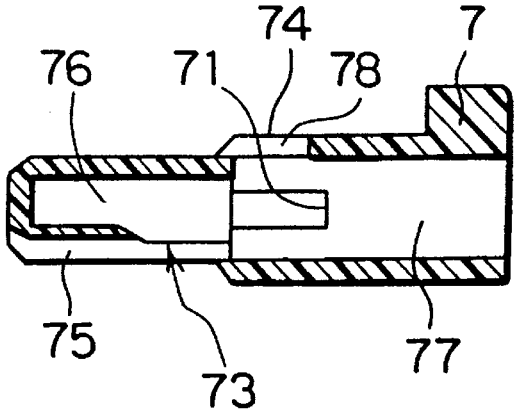
FIG. 10(B) is a sectional side view of the plug insulator illustrated FIG. 10(A)
Figure 10C:
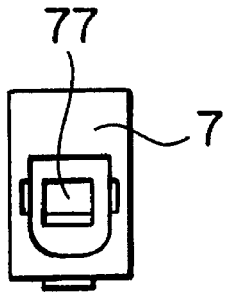
FIG. 10(C) is a rear view of the plug insulator illustrated FIG. 10(A)

In order to assemble a plug connector, the center and the outer contacts 1 and 2 press-fitted to the coaxial cable 8 as described above are accommodated in a plug insulator 7 illustrated in FIGS. 10(A), 10(B), and 10(C). Thus, the plug connector 10 is formed as shown in FIG. 11.

Figure 11:
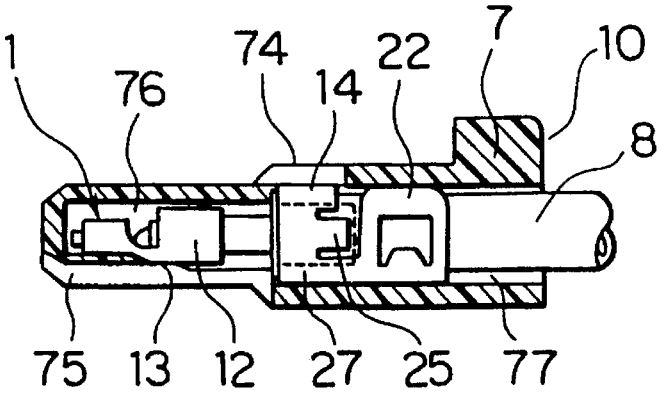
FIG. 11 is a sectional side view of the plug connector with the terminal contact set attached to the cable end of the coaxial cable in FIG. 8 accommodated into the plug insulator illustrated in FIG. 10(B)

FIG. 11 shows the center and the outer contacts 1 and 2 accommodated in the plug insulator 7. The plug insulator 7 comprises a center contact inserting portion 76 for accommodating the center contact 1, and an outer contact inserting portion 77 adjacent to the center contact inserting portion 76 for accommodating the outer contact 2.

The plug insulator 7 is provided with a guide groove 75 for exposing the common lower end of the first holding portions 12 of the center contact 1 accommodated in the contact inserting portion 76. The common lower end of the first holding portions 12 serves as a first contacting portion 13 to be contacted to a first mating contact of a receptacle connector which will later be described. The plug insulator 7 is provided with a latch receiving portion 71 and a connection window 74. The latch receiving portion 71 is for engaging the latch portion 25 of the outer contact 2 to inhibit the outer contact 2 accommodated in the outer contact inserting portion 77 from being pulled out by a force acting in a pull-out direction of the coaxial cable 8. The connection window 74 is for exposing upper ends of the second holding portions 27 of the outer contact 2 accommodated in the outer contact inserting portion 77 to bring a second mating contact of the receptacle connector into contact with the upper ends. The upper ends of the second holding portions 27 serve as a second contacting portion 14 to be brought into contact with the second mating contact of the receptacle connector.

Figure 12:
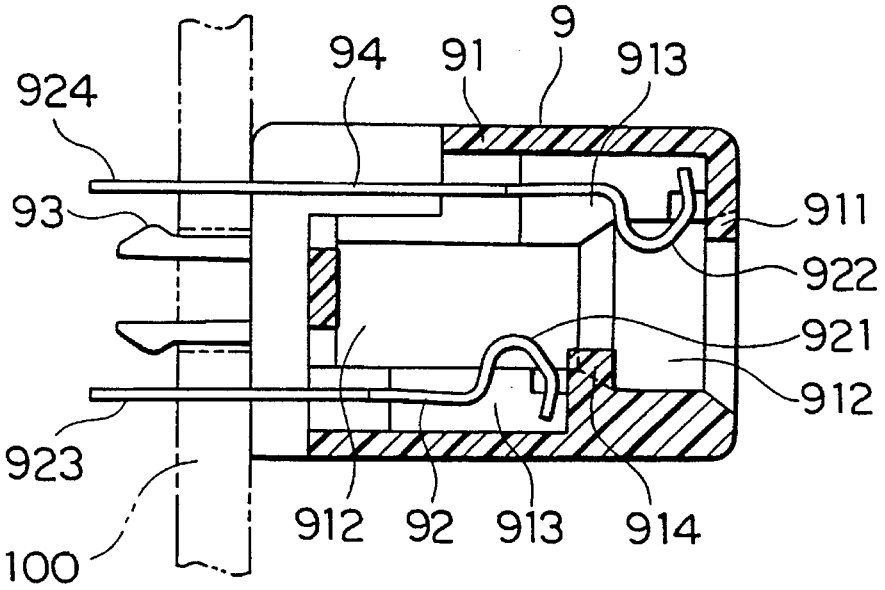
FIG. 12 is a sectional view of a receptacle connector to be mated with the plug connector shown in FIG. 11.

FIG. 12 shows the receptacle connector 9 to be coupled to the plug connector 10. The receptacle connector 9 comprises a receptacle or mating insulator 91, and the first and the second mating contacts 92 and 94 accommodated in the mating insulator 91. The mating insulator 91 has an insertion port for insertion of the insulator 7. A first guide key 911 is formed at the insertion port to guide the insulator 7 inserted in the mating insulator 91 so as to achieve accurate coupling therebetween. A second guide key 914 is formed at a slightly inner position slightly inward from the insertion port. A receiving hole 912 is formed inside of the mating insulator 91 to receive the center contact inserting portion 76 and the outer contact inserting portion 77 of the plug connector 10. First and second mating contacting portions 921 and 922 of the first and the second mating contacts 92 and 94 are exposed in the receiving hole 912.

Specifically, the mating insulator 91 is provided with outout windows 913 opened towards the receiving hole 912. The first and the second mating contacting portions 921 and 922 of the first and the second mating contacts 92 and 94 are protruded through the outout windows 913 towards the center of the receiving hole 92.

The mating insulator 91 is provided at its bottom with hold-downs 93 for fixing the mating insulator 91 to a substrate 100 such as a printed circuit board. First and second terminal portions 923 and 924 of the first and the second mating contacts 92 and 94 are projected from the bottom of the mating insulator 91 to be connected to an electroconductive portion of the substrate 100. The first and the second mating contacting portions 921 and 922 of the first and the second mating contacts 92 and 94 are brought into contact with the first and the second contacting portions 13 and 14, respectively.

The first and the second mating contacts 92 and 94 are made of contact spring pieces having elasticity to assure reliable electrical connection between the cable connecting contact and the first and the second mating contacts 92 and 94 when the plug connector 10 is coupled to the receptacle connector 9. With an urging force applied, the first and the second mating contacting portions 921 and 922 are tightly brought into contact with the first and the second contacting portions 13 and 14 of the plug connector 10, respectively.

The first and the second guide keys 911 and 914 of the mating insulator 91 are adapted to be slidably coupled to the connection window 74 and the mate guide groove 75, respectively. The first and the second guide keys 911 and 914 have different configurations corresponding to the connection window 74 and the mate guide groove 75, respectively, to inhibit a coupling error. When the plug connector 10 and the receptacle connector 9 are coupled to each other, the mate guide groove 75 and the connection window 74 are slidably coupled to the first and the second guide keys 911 and 914, respectively, without causing mis-mate therebetween.

Figure 13:
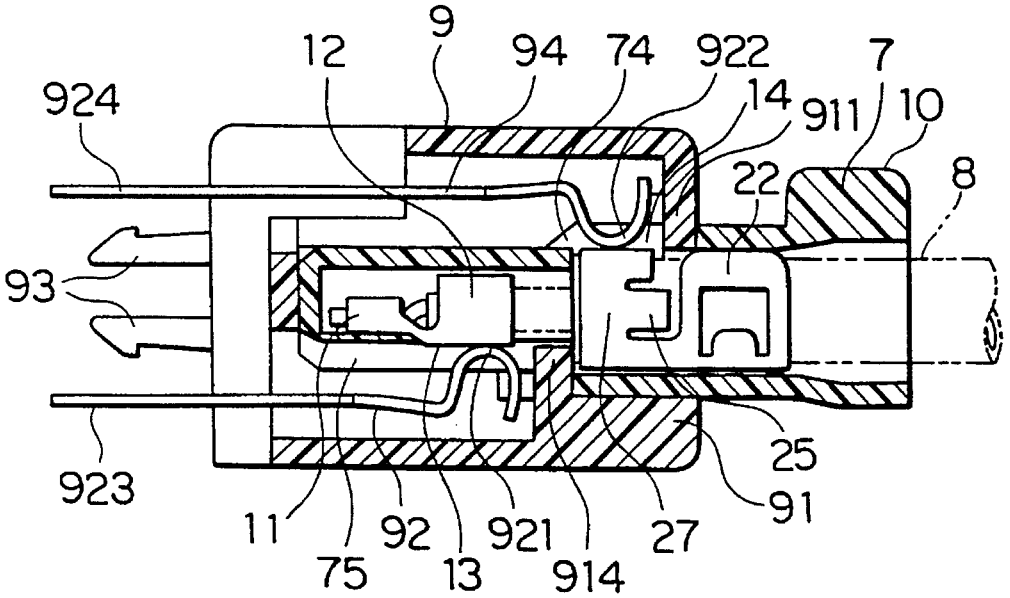
FIG. 13 is a sectional side view of the plug connector in FIG. 11 and the receptacle connector in FIG. 12 which are coupled to each other.

FIG. 13 shows the plug connector 10 and the receptacle connector 9 connected to each other. As illustrated in the figure, the first and the second mating contacting portions 921 and 922 of the first and the second mating contacts 92 and 94 are connected to the first and the second contacting portions 13 and 14 of the plug connector 10, respectively.

As described above, the center and the outer contacts 1 and 2 are simultaneously formed from a single material together with the contact frame with the center contact 1 and the outer contact 2 integrally connected to the carriers 3*a* and 3*b* coupled through the bridges 5. The coaxial cable 8 is electrically connected to the center contact 1 and the outer contact 2 simple by mechanical coupling and press-fitting therebetween. Accordingly, it is possible according to this invention to reduce the number of assembled parts and to save the cost.

In addition, the center contact 1 and the external contact 2 are simultaneously press-fitted to the coaxial cable 8. Accordingly, a soldering operation is not required. It is therefore possible to considerably reduce the number of assembly steps as compared with the conventional technique in which the center contact 1 and the external contact 2 are individually press-fitted in separate processes. This contributes to a reduction of the cost. In addition, the press-fitting operation is very easily carried out as compared with the soldering operation. Thus, no special skill is required.

Upon press-fitting, the center and the outer contacts 1 and 2 can be accurately connected to the coaxial cable 8 without any interference or collision between the center and the outer contacts 1 and 2 and other components.

The center contact 1 and the outer contact 2 are formed from the single electroconductive plate material together with the carriers 3*a* and 3*b* integrally connected thereto. Accordingly, it is possible by use of a single kind of the die to punch the center and outer contacts. Being coupled to each other, the center contact 1 and the outer contact 2 are simultaneously press-fitted to the coaxial cable 8. Therefore, a single press-fit operation is sufficient with a single kind of the press-fit jigs 101 and 102.

The carriers 3*a* and 3*b* holding the center and the outer contacts 1 and 2 are coupled to each other before completion of the press-fitting operation. Therefore, the components are avoided from being lost prior to and throughout the operation.

What is claimed is:

1. A method for attaching terminal contacts to a cable end of a coaxial cable comprising a first conductor centered inside, a second conductor extending coaxial with said first conductor, a first insulating cover covering and insulating said first conductor from said second conductor, and a second insulating cover covering said second conductor, said terminal contacts comprising an electroconductive first contact element to be electrically connected to an end of said first conductor at the cable end and an electroconductive second contact element to be electrically connected to said second conductor, said method comprising steps of;

preparing a contact frame by punching an electroconductive plate material, said contact frame comprising said first contact element, said second contact element, a first frame portion carrying said first contact element, a second frame portion carrying said second contact element, and a bridge portion connecting said first and said second frame portions with a first distance left therebetween to thereby maintain a first predetermined positional relation between said first and said second contact elements;

processing the cable end of said coaxial cable to thereby expose said first conductor end, said first insulating cover at the cable end, and said second conductor end, said first conductor end and said second conductor end being separated said first distance from each other by said first insulating cover along said coaxial cable to thereby have a second predetermined positional relation therebetween which matches to said first predetermined positional relation;

attaching said contact frame to said cable end so that said first contact element and said second contact element are secured to said first conductor end and said second conductor end, respectively; and separating said first contact element and said second contact element from said first frame portion and said second frame portion, respectively.

2. A contact frame used in the method as claimed in claim 1, said contact frame being made by punching an electroconductive plate material, and comprising:

a first contact portion for said first contact element;

a second contact portion for said second contact element;

a first frame portion carrying said first contact portion;

a second frame portion carrying said second contact portion; and a bridge portion connecting said first and said second frame portions with a first distance left therebetween to thereby maintain a first predetermined positional relation between said first and said second contact portions.

3. A contact carrier tape for supplying a contact frame in the method as claimed in claim 1, said contact carrier tape being made by periodically and sequentially punching a metal strip and comprising:

a first and a second strip extending in parallel to each other with a space left therebetween;

a plurality of first contact portions carried by said first strip at first intervals, each of said first contact portions being for said first contact element;

a plurality of second contact portions carried by said second strip at second intervals equal to said first intervals, each of said second contact portions being for said second contact element; and a plurality of bridge portions connecting said first and said second strips at third intervals to thereby maintain said space along said first and said second strips and a first predetermined positional relation between each one of said first contact portions and an adjacent one of said second contact portions, whereby said contact carrier tape comprising a plurality of contact frames continuously connected to one by one.

4. The method as claimed in claim 1, wherein said first contact element comprises a first press-fit portion and a first holding portion, said first press-fit portion being crimped to press-fit onto said first conductor end and said first holding portion being crimped to hold said first cover end during said attaching step, and wherein said second contact element comprises a second press-fit portion and a second holding portion, said second press-fit portion being crimped to press-fit onto said second conductor end after penetrating said second cover and said second holding portion being crimped to hold said second cover during said attaching step.

5. The method as claimed in claim 4, wherein said second press-fit portion has a press-insert portion and a guide piece, said press-insert portion penetrating said second cover to be brought into contact with said second conductor and to clamp said first cover end in a radial direction in said attaching step and said guide piece guiding said second cover to a position surrounded by said second press-fit portion in said attaching step.

6. A terminal contact set for coaxial cable comprising a center conductor, a first insulating cover covering said center conductor, an outer conductor surrounding said first cover, and a second insulating cover covering said outer conductor, said terminal contact set comprising an electroconductive center contact to be electrically connected to said center conductor and to mechanically hold said first cover, and an electroconductive outer contact to be electrically connected to said outer conductor and to mechanically hold said second cover, wherein:

said center contact comprises a first press-fit portion for press-fitting said center conductor and a first holding portion for holding said first cover, said outer contact comprising a second holding portion for holding said second cover and a second press-fit portion for press-fitting said outer conductor after penetrating said second cover, said second holding portion having a latch portion for inhibiting said cable from being released from said outer contact, said second press-fit portion having a press-insert portion for penetrating said second cover to be brought into contact with said outer conductor and to clamp said first cover in a radial direction, and a guide piece for guiding said second cover of said cable to a position surrounded by said second press-fit portion.

7. A plug connector using a terminal contact set as claimed in claim 6, wherein:

said plug connector comprises a plug insulator accommodating said center contact and said outer contact, said plug insulator comprising a center contact inserting portion accommodating said center contact, an outer contact inserting portion adjacent to said center contact inserting portion and accommodating said outer contact, and a latch receiving portion for engaging said latch portion to said outer contact inserting portion.

8. A plug connector as claimed in claim 7, wherein said plug insulator comprises a guide groove for exposing as a first contacting portion a part of said first holding portion outwardly from said center contact inserting portion, and a connecting window for exposing as a second contacting portion a part of said second press-fit portion outwardly from said outer contact inserting portion.

9. A receptacle connector to be connected to the plug connector as claimed in claim 7 or 8, wherein:

said receptacle connector comprises a receptacle insulator to be connected to said plug insulator of said plug connector, said receptacle insulator having a receiving hole for fitting said insulator, said receiving hole being equipped with first and second electroconductive mating contacts, said first mating contact having a first mating contacting portion to be contacted to said first contacting portion exposed at said guide groove, said second mating contact having a second mating contacting portion to be connected to said second contacting portion exposed at said connection window.

10. A receptacle connector as claimed in claim 9, wherein said receptacle insulator has guide keys for slidably coupling said guide groove and said connection window to said receiving hole to prevent erroneous coupling with said plug connector.

* * * * *